US006892486B2

(12) United States Patent
Haggard, Jr.

(10) Patent No.: US 6,892,486 B2
(45) Date of Patent: May 17, 2005

(54) BANNER DISPLAY SYSTEM

(76) Inventor: William Luther Haggard, Jr., 27339 Carl Dr., Harvest, AL (US) 35749

( * ) Notice: Subject to any disclaimer, the term of this patent is extended or adjusted under 35 U.S.C. 154(b) by 0 days.

(21) Appl. No.: 10/616,616

(22) Filed: Jul. 10, 2003

(65) Prior Publication Data

US 2004/0103573 A1 Jun. 3, 2004

Related U.S. Application Data

(63) Continuation of application No. 09/881,496, filed on Jun. 14, 2001, now abandoned.

(51) Int. Cl.[7] ..... G09F 7/00; G09F 17/00
(52) U.S. Cl. ..... 40/604; 597/591; 597/592
(58) Field of Search ..... 40/604, 603, 597, 40/606.01, 607.01, 591–593; 160/377

(56) References Cited

U.S. PATENT DOCUMENTS

| | | | | | |
|---|---|---|---|---|---|
| 1,406,916 | A | * | 2/1922 | Arnold | 40/606.11 |
| 2,243,912 | A | | 6/1941 | Legler | |
| 2,865,124 | A | * | 12/1958 | Mortellito | 40/605 |
| 3,148,856 | A | | 9/1964 | Orlando | |
| 3,494,405 | A | * | 2/1970 | Bartelmas et al. | 160/24 |
| 3,633,299 | A | | 1/1972 | Westlin | |
| 3,818,599 | A | | 6/1974 | Tague | |
| 3,955,786 | A | | 5/1976 | Duddy | |
| 3,966,231 | A | | 6/1976 | Metzler | |
| 4,012,056 | A | | 3/1977 | Christensen | |
| 4,169,610 | A | | 10/1979 | Paufler | |
| 4,365,435 | A | | 12/1982 | Snyder | |
| 4,574,726 | A | | 3/1986 | Sullivan | |
| 4,666,176 | A | | 5/1987 | Sand | |
| 4,667,428 | A | | 5/1987 | Elmer | |
| 4,700,655 | A | | 10/1987 | Kirby | |
| 4,723,788 | A | | 2/1988 | Suter | |
| 4,866,866 | A | | 9/1989 | Rotter et al. | |
| 4,878,303 | A | | 11/1989 | Banniza et al. | |
| 4,937,962 | A | | 7/1990 | Hornblad | |
| 5,113,588 | A | | 5/1992 | Walston | |
| 5,172,505 | A | | 12/1992 | Borsella | |
| 5,181,284 | A | | 1/1993 | Raphael et al. | |
| 5,269,554 | A | | 12/1993 | Law et al. | |
| 5,502,909 | A | | 4/1996 | Rabkin | |
| 5,558,352 | A | | 9/1996 | Mills | |
| D378,669 | S | | 4/1997 | Gregory | |
| 5,737,862 | A | | 4/1998 | Cooper et al. | |

FOREIGN PATENT DOCUMENTS

| | | | | |
|---|---|---|---|---|
| DE | 2611922 A | * | 9/1977 | B60Q/7/00 |
| GB | 2 360 021 A | | 7/2000 | |
| WO | WO 95/20208 | | 7/1995 | |

* cited by examiner

*Primary Examiner*—Cassandra Davis
(74) *Attorney, Agent, or Firm*—Luedeka, Neely & Graham PC

(57) ABSTRACT

A display system, including a frame member having a lower end with a threaded bore therein, a banner supported by the frame member, and a mount for mounting the frame member onto a surface, the mount including a suction cup having a force cup opposite a blind bore, a threaded bolt having a head configured for being received within the blind bore of the suction cup, and a connector, the connector having internal threads configured for receiving the threads of the bolt and external threads configured for being received by the threaded bore of the lower end of the frame member.

1 Claim, 11 Drawing Sheets

BANNER DISPLAY SYSTEM

CROSS-REFERENCE TO RELATED APPLICATION

This application is a continuation of application Ser. No. 09/881,496 filed Jun. 14, 2001 now abandoned, and entitle BANNER DISPLAY SYSTEM.

FIELD OF THE INVENTION

The present invention relates to displays. More particularly, the invention relates to systems for displaying banners, signage and the like.

BACKGROUND AND SUMMARY OF THE INVENTION

Various devices for displaying signs and banners are known in the art. However, such devices desire improvement in that they are typically unduly heavy or awkward or difficult to assemble and use. Accordingly, there is a need in the art for an improved system for displaying signs and banners and, particularly signs and banners made of non-rigid sheet materials.

The present invention relates to a display system.

In a preferred embodiment, the display system includes a frame member having a lower end with a threaded bore therein, a banner supported by the frame member, and a mounting system for mounting the frame member onto a surface.

In one embodiment, the mounting system includes a suction cup having a force cup opposite a blind bore, a threaded bolt having a head configured for being received within the blind bore of the suction cup, and a connector, the connector having internal threads configured for receiving the threads of the bolt and external threads configured for being received by the threaded bore of the lower end of the frame member.

In another embodiment, the mounting system includes a suction cup having a force cup opposite a blind bore and a threaded bolt having a head configured for being received within the blind bore of the suction cup, wherein the end of the frame member is molded directly onto the end of the threaded bolt.

BRIEF DESCRIPTION OF THE DRAWINGS

Further aspects of the invention will become apparent by reference to the detailed description of preferred embodiments when considered in conjunction with the figures, which are not to scale, wherein like reference number, indicate like elements through several views.

DETAILED DESCRIPTION

FIGS. 1–3*b*

Figure 1:
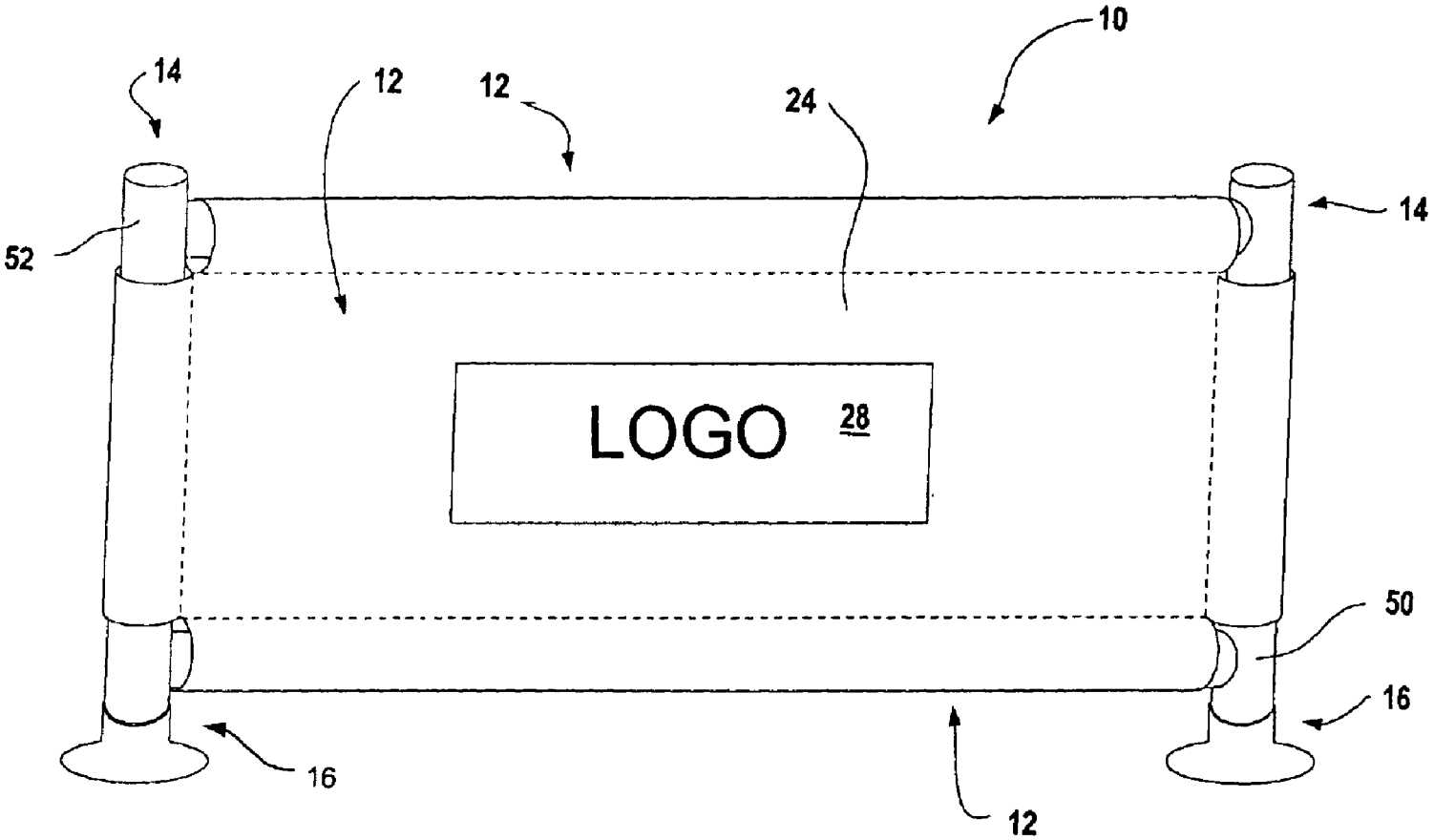
FIG. 1 is a perspective view of a display system in accordance with a preferred embodiment of the invention.
Figure 1A:
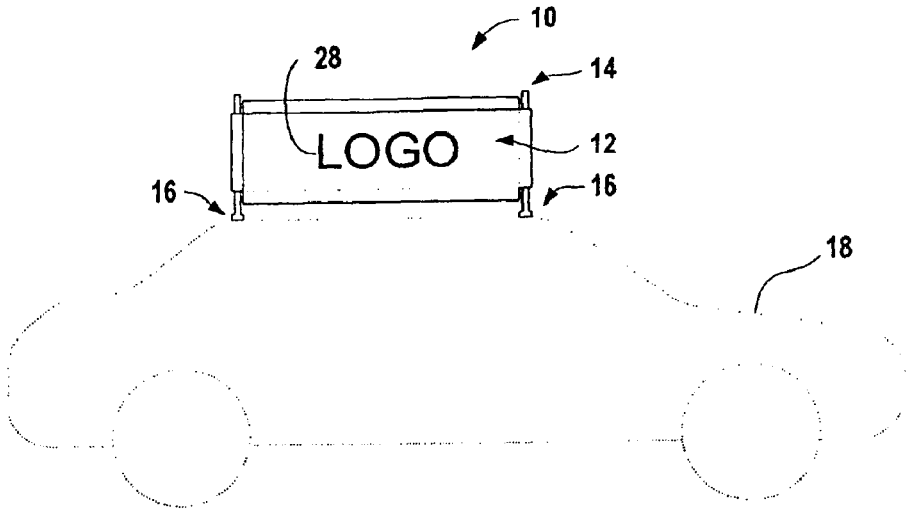

With initial reference to FIGS. 1, 1*a*, 2 and 2*a*, the invention relates to a display system 10 that is particularly suitable for displaying signs and banners on surfaces, such as on car and truck roofs as well as other forms of transportation while traveling at relatively low speeds, e.g., preferably less than about 40 miles per hour. The display system 10 preferably includes a banner 12, a frame system 14 to support the banner member 12, and a mounting system 16 for mounting the display system onto a surface, such as the roof of an automobile 18.

The banner 12 is preferably substantially rectangular or square in configuration and made of a flexible, non-rigid sheet material 20 such as a solid or mesh-type vinyl or cloth material. With reference to FIG. 2*a*, the sheet material 20 is preferably provided as a one-piece blank 22 including a front surface 24 and an opposite back surface 26, preferably having indicia or logo 28 located on one or both of the surfaces 24 and 26 (FIG. 1). The indicia 28 is preferably applied to the banner 12 as by screen printing or the like.

The blank 22 also preferably includes end portions 30 and 32, and side portions 34 and 36. The blank 22 may preferably be made into the banner 12 as by folding each of the portions 30, 32, 34 and 36 about itself and securing free edges 30*a*, 32*a*, 34*a*, and 36*a* of each of the portions 30–36 to the material 20. The free edges may be secured to the material 20 as by stitches, hook and loop material or the like, at respective locations corresponding to that represented by dashed lines 38, so as to form sleeves 40, 42, 44 and 46. The resulting banner 12 may be of virtually any size, but preferably has a length of from about 4 to about 12 feet and a width of from about 1 to about 4 feet, for use on with an automobile. For other uses, such as for displaying a banner on the top of a computer monitor, the banner preferably has a length of from about 8 to about 14 inches and a width of from about 1 to about 4 inches.

Figure 2:
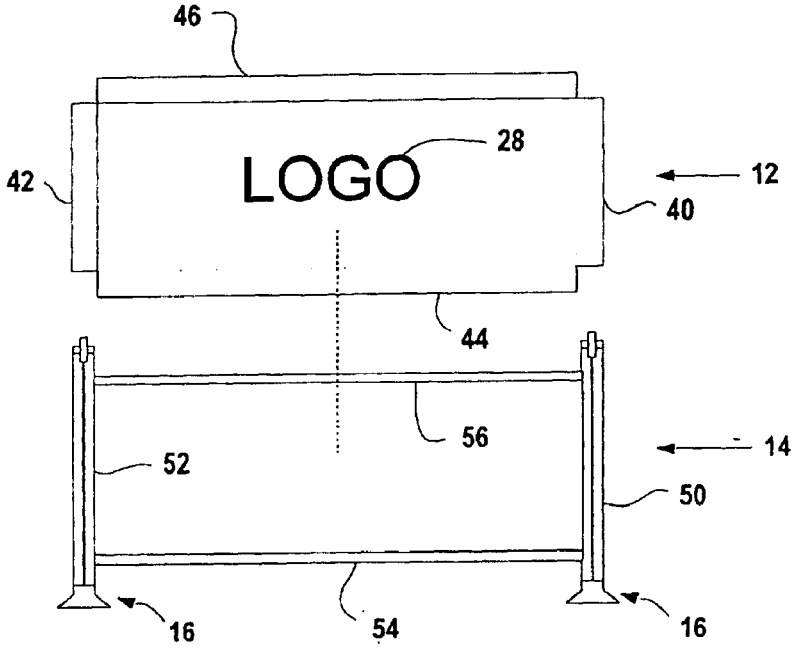
FIG. 2 is an exploded view of the display system of FIG. 1.
Figure 2A:
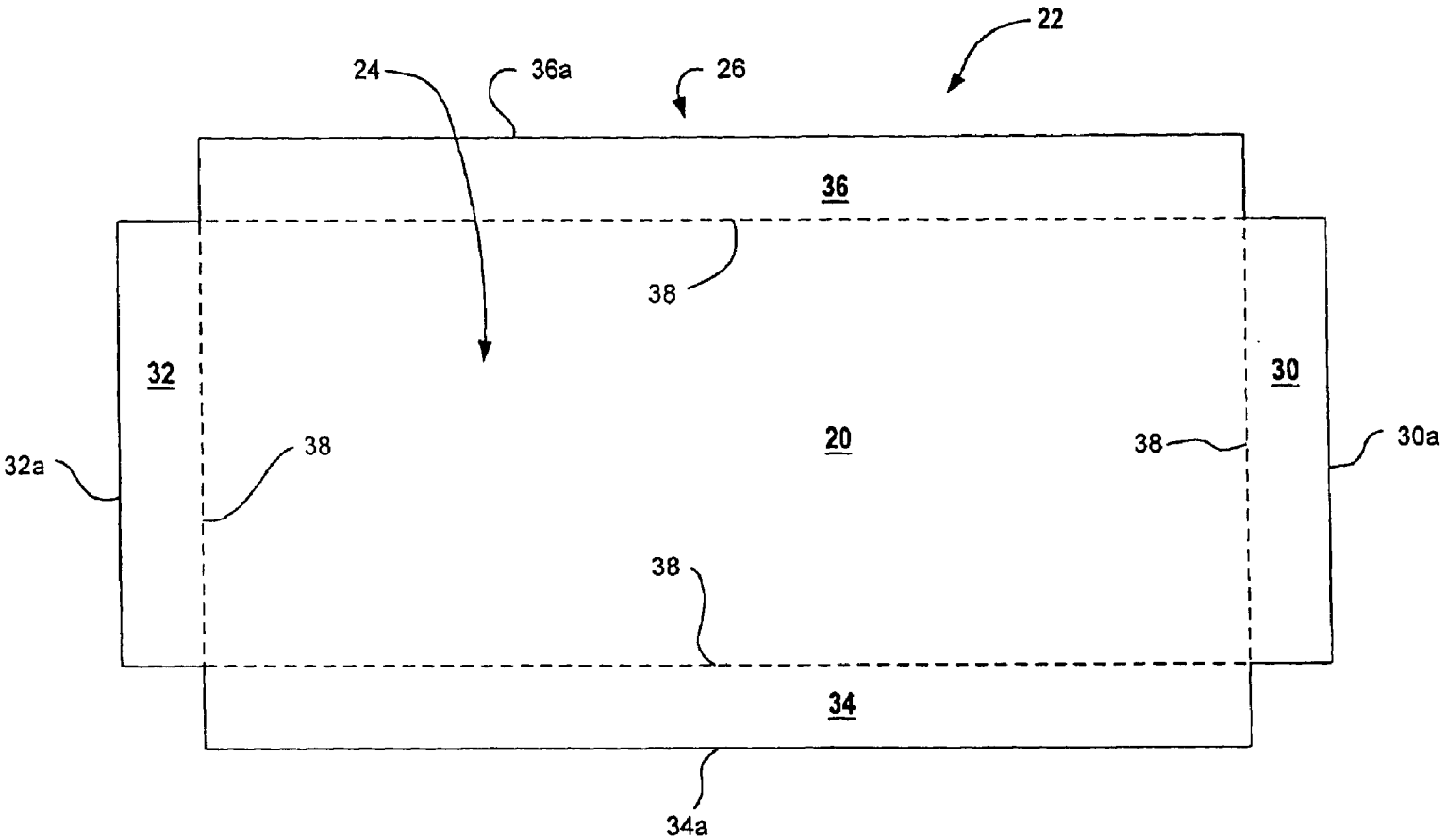
FIG. 2*a* is a front plan view of a blank used to make the banner portion of the display system.
Figure 3:
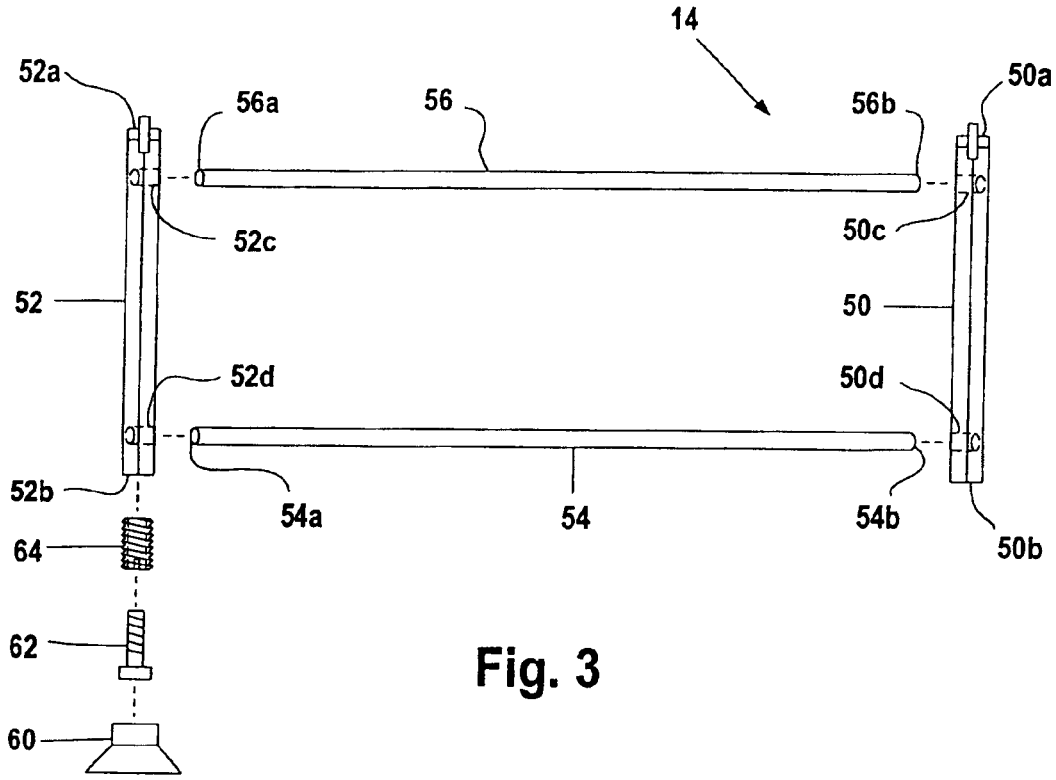
FIG. 3 is an exploded view of a frame assembly used in the display system of FIG. 2.

With reference to FIGS. 2 and 3, the frame system 14 preferably includes elongate frame members 50, 52, 54 and 56, preferably made of a wood or a plastic material. The members 50–56 are preferably round or square or X-shaped in cross-section. The frame member 50 has opposite ends 50*a* and 50*b*. Likewise, the other frame members 52–56 have opposite ends designated with the suffixes a and b. The member 50 preferably has apertures 50*c* and 50*d* adjacent the ends 50*a* and 50*b* configured for receiving the ends 56*b* and 54*b* of the members 56 and 54, respectively. Likewise, the member 52 preferably has apertures 52*c* and 52*d* adjacent the ends 52*a* and 52*b* and configured for receiving the ends 56*a* and 54*a* of the members 56 and 54, respectively.

The sleeves 40–46 of the banner 12 are configured for slidably receiving the members 50–56, respective. Accordingly, the members 50–56 are initially received within the sleeves 40–46 and the frame system 14 assembled by placing and securing the ends of the members 54 and 56 in the apertures 50*c*, 50*d*, 52*c*, and 52*d*. Securement is preferably achieved as by friction fit or adhesive.

The ends 50*b* and 52*b* of the members 50 and 52 are configured for connection with components of the mounting system 16. In this regard, and with reference to FIGS. 3, 3*a* and 3*b*, each mounting system 16 preferably includes a suction cup 60, a bolt 62 and a connector 64.

Each suction cup 60 has a force cup 66 opposite a blind bore 68. Each bolt 62 has a head 70 and a threaded shaft 72 extending from the head 70. The bore 68 is configured for receiving and frictionally retaining the head 70 of the bolt. Additional securement of the head 70 within the bore 68 may be achieved as by adhesive.

Each connector 64 is preferably cylindrical, having fine, machine treads 74 on the interior sidewall thereof and wood type threads 76 on the exterior surface thereof. A preferred connector is a double-threaded insert available under the trade name HELI-COIL from Heli-Coil Corporation of Danbury, Conn.

A notch 78 is provided on end 80 of the connector 64 for receiving a tool, such as a screwdriver, for of turning the connector for threading opposite end 82 of the connector into a threaded bore 84 defined at the ends 50*b* and 52*b* of the members 50 and 52 and preferably extending substantially along the center line of the members 50 and 52. As will be appreciated, each bore 84 is preferably configured for threadably receiving the threads 76 of the connector 64. Likewise, the threads 74 are configured for receiving the threaded shaft 72 of the bolt 62.

Figure 3A:
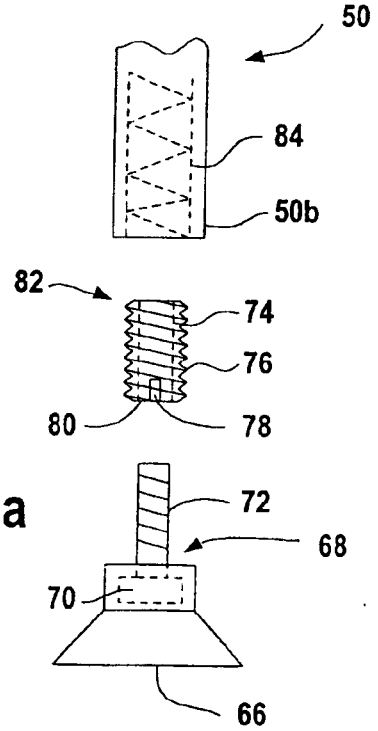
FIG. 3*a* is an enlarged view of a base assembly portion of the frame system of FIG. 3.
Figure 3B:
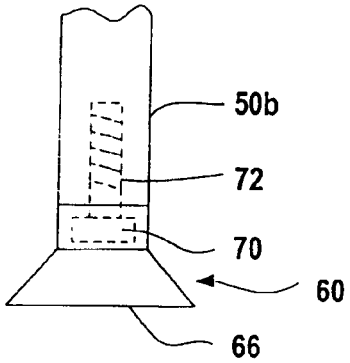
FIG. 3*b* is an alternate embodiment of a base assembly.

With reference to FIG. 3*b*, in an alternate embodiment, and in the case of molded plastic members 50 and 52, the mounting system 16 may include only the cup 60 and bolt 62, with the end 50*b* of the member (or the end 52*b* of the member 52) molded around the threaded shaft 72 during manufacture of the members 50 and 52.

FIGS. 4–8

Figure 4:
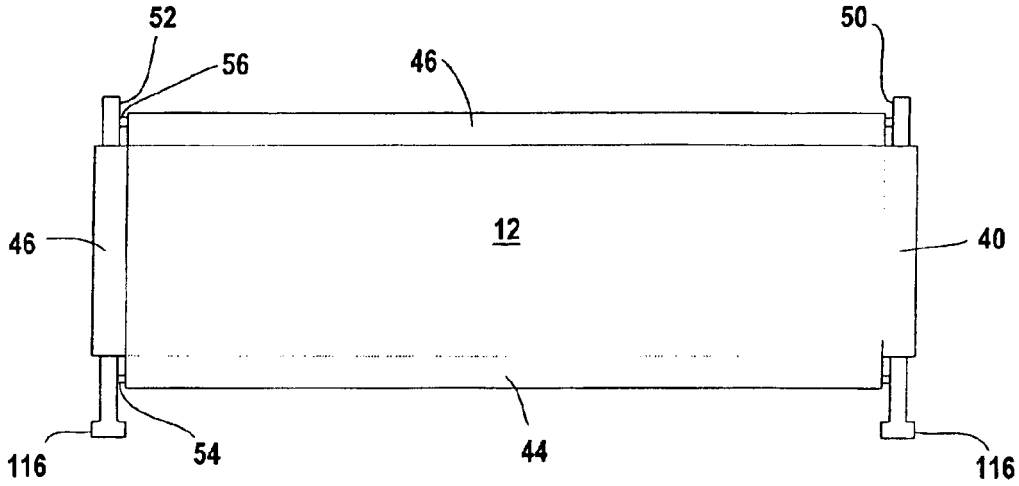
FIG. 4 is a front plan view of an alternate embodiment of a display system in accordance with the invention.

Turning now to FIG. 4, there is shown an alternate embodiment of a display system 110 having a banner 112, a frame system 114 to support the banner member 112, and a mounting system 116 for mounting the display system onto a surface, such as the roof of an automobile. The banner 112 and frame system 116 are preferably substantially identical to the previously described banner 12 and frame system 14.

Figure 5:
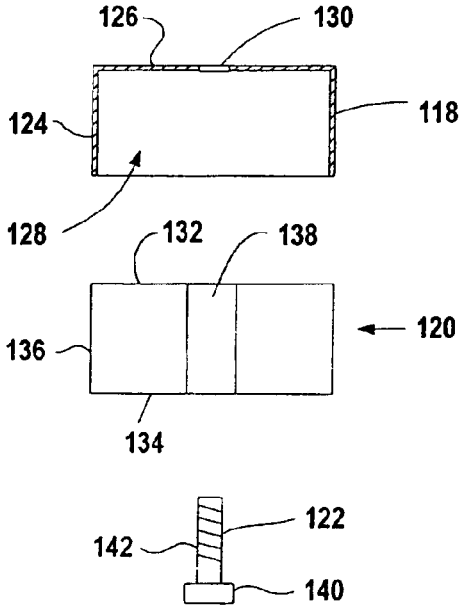
FIG. 5 is an exploded view of a base assembly portion of the display system of FIG. 4.
Figure 6:
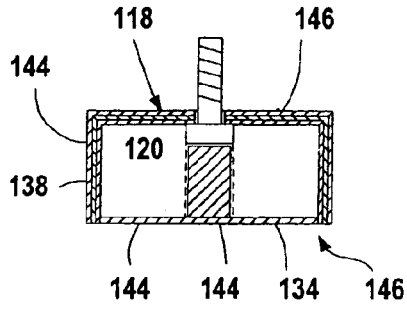
FIG. 6 is a side view of the assembled base assembly of FIG. 5.
Figure 6A:
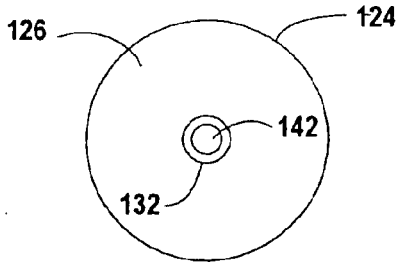
FIG. 6*a* is a top plan view thereof.

With reference to FIGS. 5 and 6, each mounting system 116 includes a cup portion 118, a magnet 120 and a bolt 122.

The cup 118 is preferably either of a thin metal material, such as tin, or of molded plastic construction. The cup 118 preferably includes a substantially circular and continuous sidewall 124 and a substantially circular top 126 adjacent the sidewall 124 so as to define a blind bore 128 interior of the sidewall. An aperture 130 preferably extends through a center portion of the top 126.

The magnet 120 is preferably substantially donut-shaped, having flat upper and lower surfaces 132, 134, circular and continuous sidewall 136 and a bore 138 defined at the center of the surfaces 132, 134 and extending there between. The bolt 122 includes a head 140 and a threaded shaft 142 extending therefrom. The magnet is preferably sized slightly smaller than the bore 128 of the cup.

The aperture 130 of the cup 118 is sized to permit passage of the threaded shaft 142, but not the head 140. The bore 138 is sized to receive the head 140 as well as the threaded shaft 142.

With reference to FIG. 6. The mounting system 116 may be assembled by coating the interior of the bore 128 with an epoxy material 144 and then placing the magnet 120 within the bore 128 of the cup 118 so that the aperture 130 and the bore 138 are concentric. As noted above, the magnet 120 is slightly smaller in dimension than the bore 128. Thus, a void area 146 exists that may be occupied by the epoxy 144. The bolt 120 is then passed through the bore 138 and the aperture 130 and an additional amount of the epoxy 144 added to fill the bore 138 and to substantially encase the exterior of the cup 118 and the surface 134 of the magnet. The epoxy is then allowed to cure or set. As will be appreciated, the epoxy retains the components of the system 116 from relative movement with respect to one another and further provides an external coating that is generally suitable for placing on a painted metal body, such as an automobile roof, without scratching it.

Figure 8:
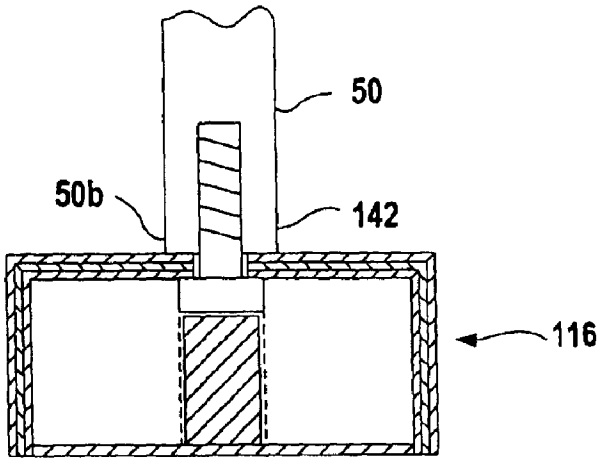
FIGS. 7 and 8 show connection of the base assembly of FIG. 6 to a frame portion of the display system of FIG. 4 in accordance with preferred embodiments of the invention.
Figure 7:
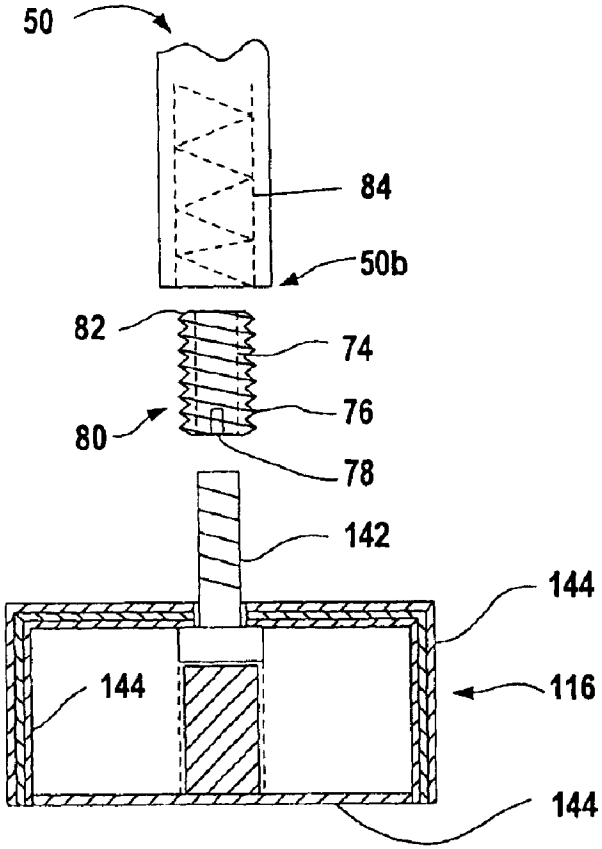

Turning to FIGS. 7 and 8, the end 50*b* of the member 50 (and the end 52*b* of the member 52) may be attached to the mounting system 116 in the same manner as described previously for the end 50*b* of the member 50 in connection with the mounting assembly 16 and with reference to FIGS. 3*a* and 3*b*. That is, FIG. 7 shows use of a connector 80 and FIG. 8 shows direct molding of the member 50 onto the threaded shaft 142.

FIGS. 9–11*a*

Figure 9:
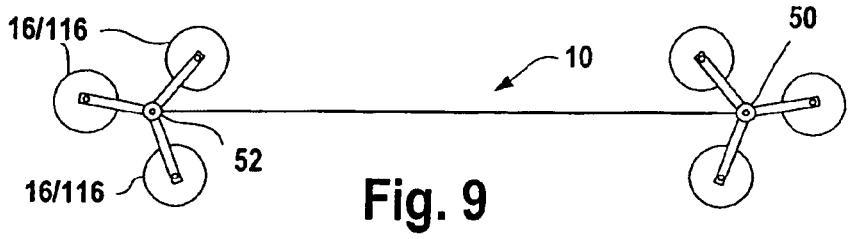
FIGS. 9, 9*a*, 10, 10*a*, 11, and 11*a* show alternate arrangements of the base systems in accordance with preferred embodiments of the invention.
Figure 9A:
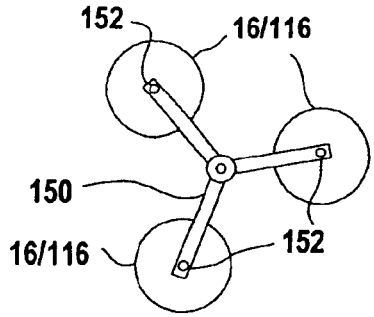
Figure 10:
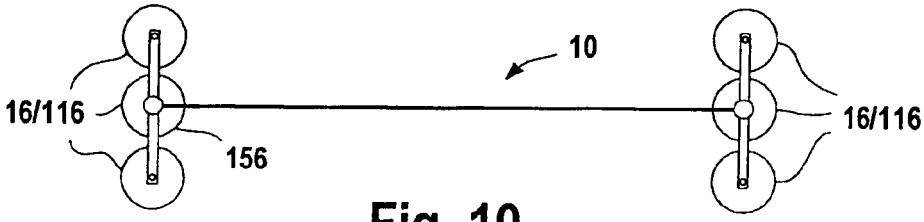
Figure 10A:
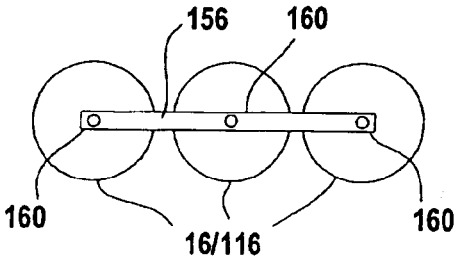
Figure 11A:
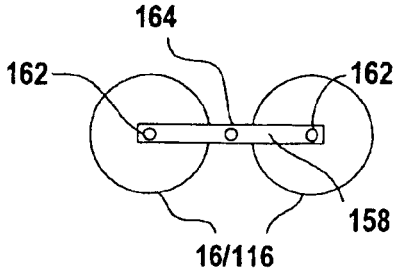
Figure 11:
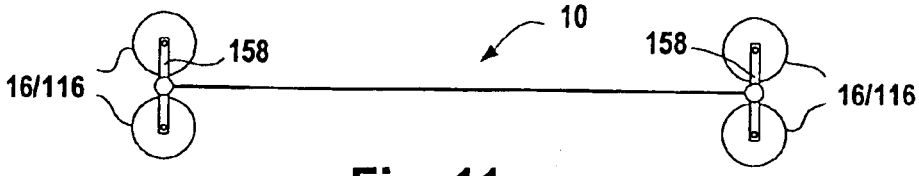

With reference now to FIGS. 9–11*a*, there are shown additional orientations of the mounting systems 16 and 116. For example, as seen in FIGS. 9 and 9*a*, the mounting may be accomplished by each side of the display system 10 being supported by a plurality of the mounting systems 16 or 116 joined together as by a metal or rigid plastic tripod 150. The tripod 150 includes apertures 152 for receiving the threaded bolts of the systems 16 or 116 (or combinations thereof) and may be secured thereto as by a nut threaded onto the bolt of the system 16 or 116. Likewise, the center of the tripod has a threaded bolt 154 secured thereto and extending upwardly to cooperate with the ends of the members 50 and 52 in the manners previously described in connection with the threaded bolts of the systems 16 and 116. Similarly, as seen in FIGS. 10–11*a*, other configurations of systems 16/116 may be utilized as by joining the systems 16/116 with straps 156 and 158. Strap 156 has three apertures 160 for receiving the bolts of the systems 16/116, with the bolt of the system 16/116 in the center position cooperating with the member 50 or 52. Strap 158 has apertures 162 at the ends thereof for cooperating with the bolts of the systems 16/116. A center aperture 164 receives an additional bolt for cooperating with the member 50 or 52.

Figure 12:
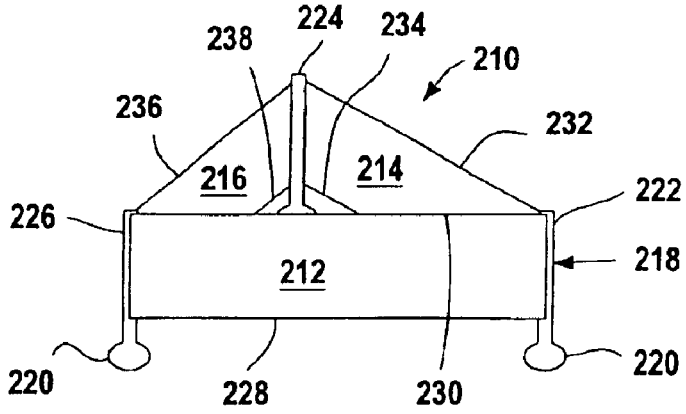
FIGS. 12, 12*a*, and 12*b* show alternate configurations of the display system in accordance with the invention.
Figure 12A:
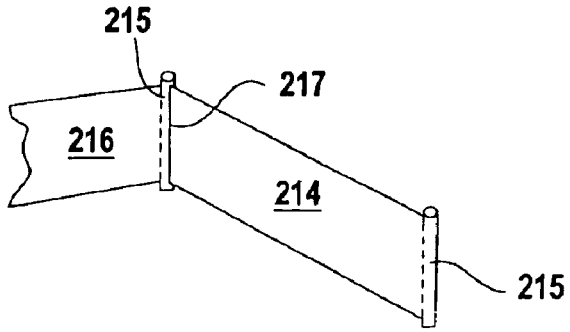
Figure 12B:
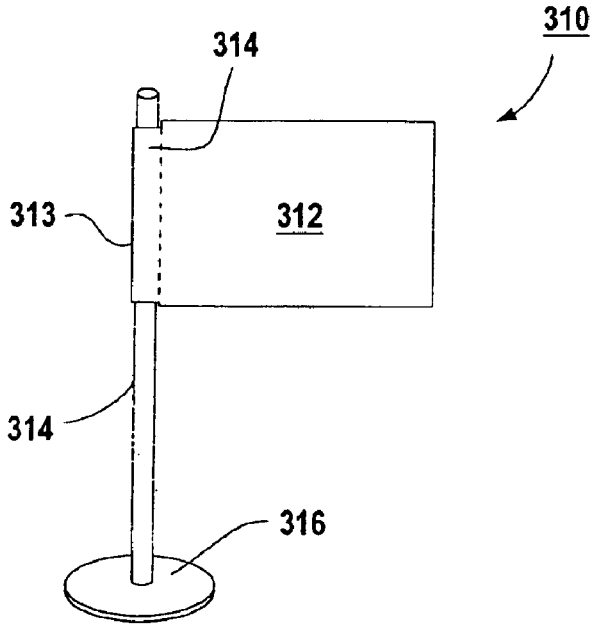

FIGS. 12–12*b*

Turning now to FIG. 12, there is shown an alternate embodiment of a display system 210 having banner members 212, 214, and 216, a frame system 218 to support banner members 212–216, and a mounting system 220 for mounting the display system on a surface, such as the roof of an automobile. Each of the banner members 212–216 is preferably substantially identical to the previously described banner 12, except that only one end of each of the banner members is configured to have a sleeve 215 for receiving a frame member. The other end of the banner member is attached, as by stitches 217, to the adjacent sleeve 215 (FIG. 12*a*). Mounting system 220 is preferably substantially identical to either previously described mounting systems 16 or 116.

Frame system 218 preferably includes elongate frame members 222, 224, and 226 which are substantially identical to frame members 50 and 52 of frame system 14. Frame system 218 also includes elongate frame members 228, 230, 232, 234, 236, and 238 which are substantially identical to frame members 54 and 56 of frame system 14.

Now turning to FIG. 12*b*, there is shown an alternate embodiment of a display system 310 having banner member 312, frame member 314 to support banner 312 and mounting system 316 for mounting the display system on a surface, such as a fender of an automobile. Frame member 314 is preferably substantially identical to frame member 52 of frame system 14. Mounting system 316 is preferably substantially identical to either previously described mounting systems 16 or 116.

Banner member 312 is preferably substantially identical to banner member 12 in configuration and construction. However, banner member 312 includes only one side configured with a sleeve 313 for slidably receiving frame member 314 in the same manner as previously described for banner member 12 receiving frame member 52.

FIGS. 13–14

Figure 13:
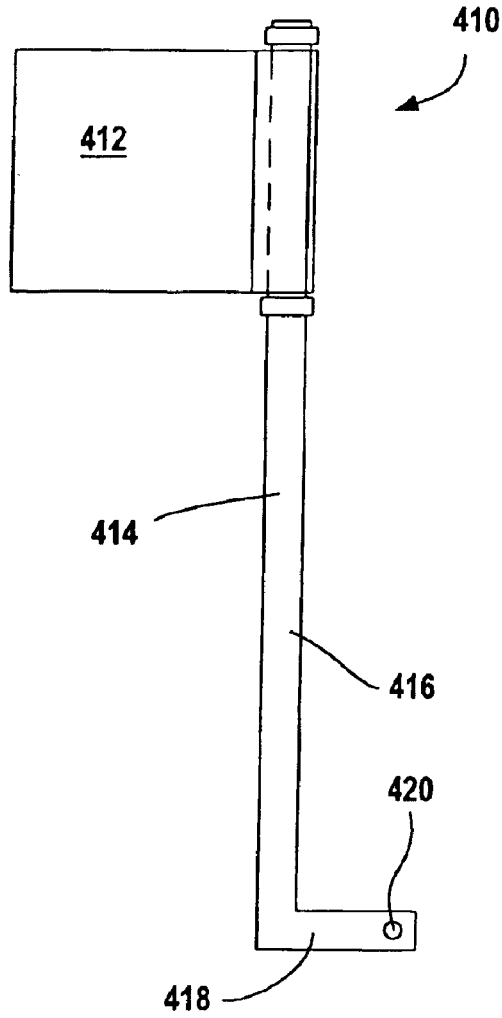
FIGS. 13 and 14 an alternate embodiment of a display system in accordance with the invention for cooperation with a tube type trailer hitch.
Figure 14:
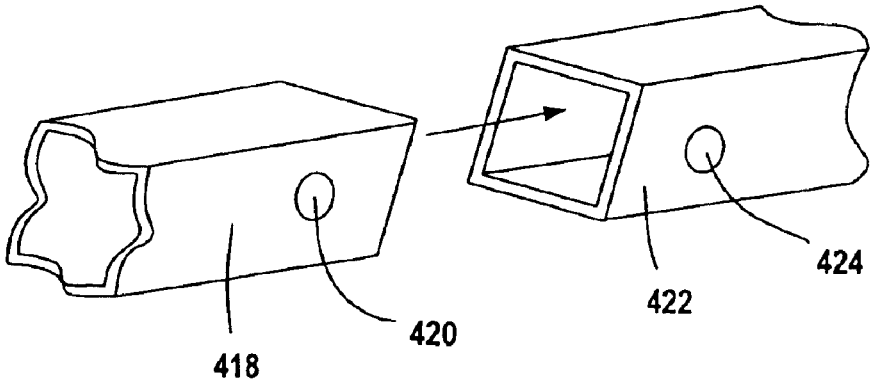

Turning to FIGS. 13 and 14, there is shown an alternate embodiment of a display system 410 including banner member 412 and frame member 414 to support banner 412 and to connect with a receiver-type trailer hitch. Banner member 412 is preferably substantially identical to banner member 312, configured for slidably receiving frame member 414 in the same manner as previously described for banner member 12 receiving frame member 52.

Frame member 414 is preferably made of a wood or plastic material. The frame member 414 is preferably L-shaped with a vertical component 416 and horizontal component 418. An aperture 420 preferably extends through horizontal component 418. Horizontal component 418 is sized slightly smaller in dimension than the receiver tube 422 of the trailer hitch, which has an aperture 424. Trailer hitch 422 is sized to receive horizontal component 418 so that apertures 420 and 424 are concentric. Apertures 420 and 424 are sized to permit passage of the shaft of a hitch pin or bolt.

FIGS. 15–16

Figure 15:
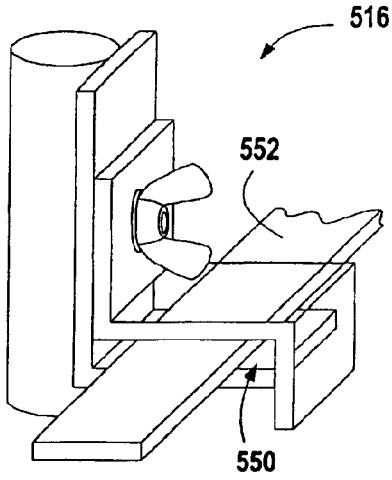
FIGS. 15 and 16 an alternate embodiment of a display system in accordance with the invention for cooperation with a roof or luggage rack of an automobile.
Figure 16:
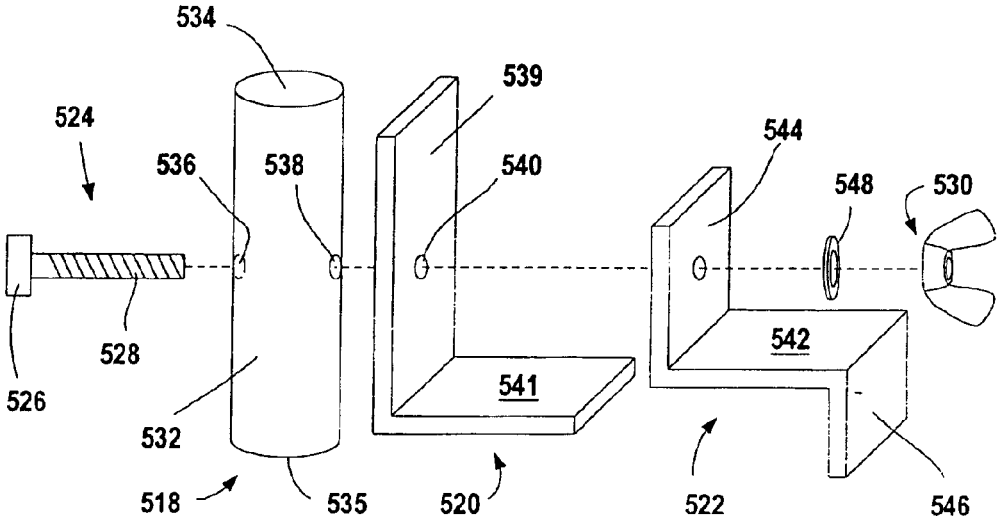

Turning to FIGS. 15 and 16, there is shown an alternate embodiment for mounting system 516 for mounting on a luggage rack of an automobile. Mounting system 516 includes cylindrical member 518, members 520 and 522, bolt 524 with head 526 and threaded shaft 528, and a wing nut 530. The members 518–522 are preferably of metal or plastic construction.

Cylindrical member 518 preferably includes a substantially circular and continuous sidewall 532 as to define a bore 534 interior of the sidewall. Bore 534 is sized to receive frame member 52 of the banner system and is closed at end 535. Apertures 536 and 538 preferably extend through a center portion of sidewall 532 so that apertures 536 and 538 are concentric. Aperture 536 is sized slightly larger than aperture 538. The aperture 536 is sized to receive the head 526 as well as the threaded shaft 528. The aperture 538 is sized to permit passage of the threaded shaft 528, but not the head 526. In this regard, it is noted that the bore 534 is sufficiently large to accommodate the frame member and the head of the bolt.

Member 520 is preferably L-shaped with aperture 540 extending through vertical portion 539 of the L-shape. Horizontal portion 541 is preferably perpendicular to the portion 539. Aperture 540 is sized to permit passage of the threaded shaft 528. Member 520 is positioned so that aperture 540 is concentric with aperture 538 of cylindrical member 518.

Member 522 preferably includes a horizontal component 542 and two vertical components 544 and 546. Vertical component 544 extends upwardly from one end of horizontal component 542 and vertical component 546 extends downwardly from the opposite end of horizontal component 542. An aperture 548 preferably extends through the center of vertical component 544. Aperture 548 is sized to permit passage of the threaded shaft 528 as well as contain wing nut 530 received on the threaded shaft. Member 522 is positioned so that aperture 548 is concentric with aperture 540 of L-shaped member 520. Bolt 524 and wing nut 530 are used to connect cylindrical member 518, L-shaped member 520 and member 522.

As will be noted, the assembled system 516 provides a channel 550 for receiving luggage rack member 552. If desired, the channel 550 may be lined with a conformable material, such as foam adhesively secured thereto, for cushioning to avoid scarring of the rack member, to provide a secure fit, and to inhibit rattling and the like.

Figure 18:
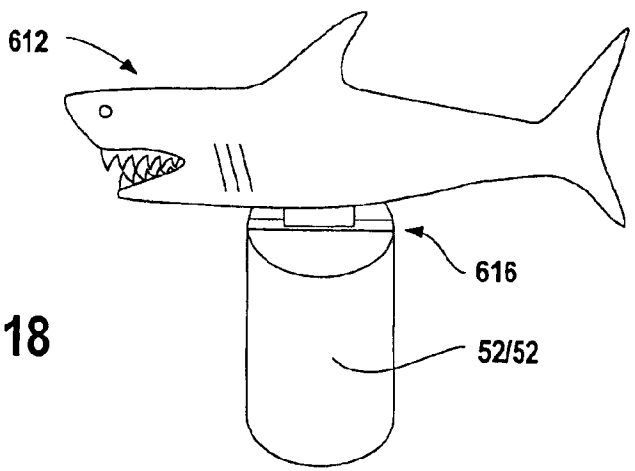
FIGS. 17, 18, and 18*a* show incorporation of decorative elements onto frame systems of the display systems of the invention.
Figure 18A:
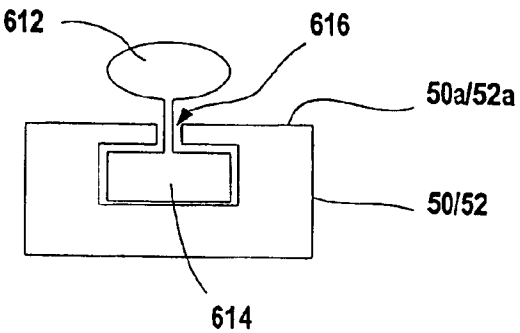
Figure 17:
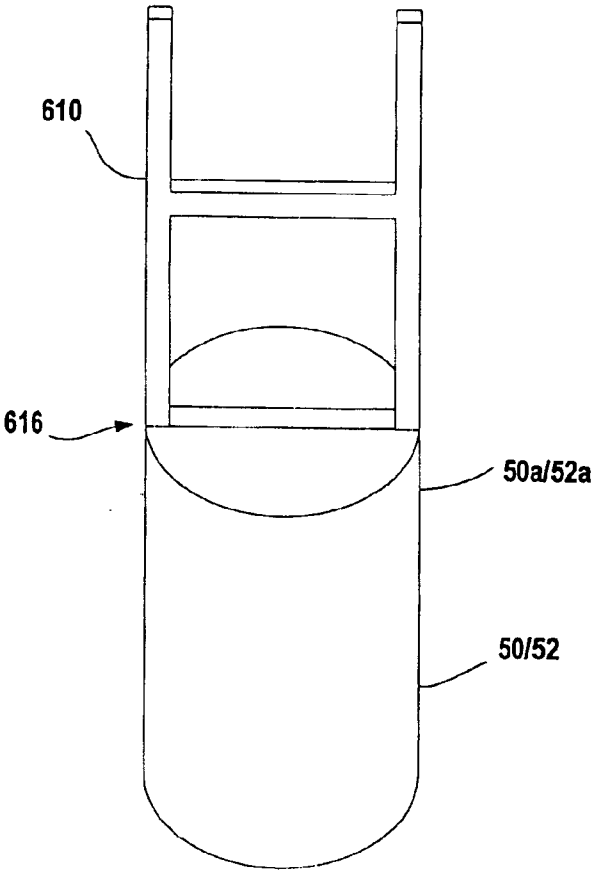

FIGS. 17–18*a*

Turning to FIGS. 17 and 18, decorative elements 610 and 612 are shown incorporated onto frame member 50 or 52 of frame assembly 14. Decorative elements, such as elements 610 and 612, can be attached to end 50*a* or 52*a* of frame member 50/52. Decorative elements 610 and 612 preferably include a rectangular base 614 which is sized to slide into slot 616 located on 50*a*/52*a* of frame member 50/52 for frictional retention and ease of replacement and interchangeability (FIG. 18*a*). Alternatively, the decorative elements may be otherwise affixed onto the frame as by fasteners or molded directly thereon.

The foregoing description of certain exemplary embodiments of the present invention has been provided for purposes of illustration only. It is understood that numerous modifications or alterations may be made in and to the illustrated embodiments without departing from the spirit and scope of the invention as defined in the following claims.

What is claimed is:

1. A display system for displaying a banner on a roof of an automobile, the system comprising:

a banner made of flexible, non-rigid sheet material, and including a plurality of elongated sleeves;

a frame system to support the banner, the frame system including a pair of horizontal frame members and a pair of vertical frame members, each slidably positionable within one of the sleeve, with each frame member having a length greater than the length of the sleeve into which it is positionable, the vertical frame members each including a pair of spaced apart apertures thereon for receiving ends of the horizontal frame members and thread structure provided adjacent an end of the each of the vertical frame members, wherein the banner and frame assembly are assembled by positioning each of the frame members within one of the sleeves and thereafter positioning the opposite ends of each horizontal frame member within one of the apertures of the vertical frame members; and a mounting system for mounting the display system on the roof of the automobile, the display system comprising a pair of suction cups, each suction cup having a force cup separate from and opposite a blind bore having a closed end separating the force cup from the blind bore and an opposite open end including a suction cup thread structure, with the suction cup thread structure being threadably mounted to one of the thread structures of the vertical frame members.

* * * * *